US008714469B2

(12) United States Patent
Pallmann

(10) Patent No.: US 8,714,469 B2
(45) Date of Patent: May 6, 2014

(54) DEVICE FOR COMMINUTING BULK CHARGE STOCK

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 404 days.

(21) Appl. No.: 13/283,534

(22) Filed: Oct. 27, 2011

(65) Prior Publication Data

US 2012/0273599 A1 Nov. 1, 2012

(30) Foreign Application Priority Data

Oct. 27, 2010 (DE) ..... 10 2010 049 485

(51) Int. Cl.
*B02C 7/17* (2006.01)

(52) U.S. Cl.
USPC ..... 241/66; 241/261.2; 241/57

(58) Field of Classification Search
USPC ..... 241/57, 62, 66, 65, 261.2, 261.3
See application file for complete search history.

(56) References Cited

U.S. PATENT DOCUMENTS 2,211,518 A * 8/1940 Scherbaum ..... 241/66
2,959,362 A 11/1960 Merrill et al.
3,055,598 A * 9/1962 Ginaven ..... 241/57
4,383,650 A * 5/1983 Contal et al. ..... 241/66
4,930,708 A * 6/1990 Chen ..... 241/65
5,531,385 A * 7/1996 Witsken ..... 241/21
7,364,100 B2 4/2008 Pallmann
2006/0086856 A1* 4/2006 Pallmann ..... 241/261.2
2009/0108112 A1* 4/2009 Wakamatsu et al. ..... 241/261.2

FOREIGN PATENT DOCUMENTS

DE 10 2004 050 002 A1 4/2006

* cited by examiner

*Primary Examiner* — Faye Francis
(74) *Attorney, Agent, or Firm* — Muncy, Geissler, Olds & Lowe, P.C.

(57) ABSTRACT

A device for comminuting bulk charge stock with a housing surrounding a rotational axis. The housing has a first front wall, a second front wall plane parallel at an axial distance and a shell wall connecting the first front wall and second front wall on the circumferential side, which together form a comminuting chamber. A comminuting system rotating about the rotational axis is arranged in the comminuting chamber, which comminuting system has first comminuting tools and second comminuting tools interacting therewith, which form a concentric comminuting zone for charge stock. In order to cool the comminuting zone effectively and economically, a cooling channel is provided, which surrounds the shell wall outside in the plane of the comminuting chamber, wherein the cooling channel has an entry opening for charging with cooling gas and an exit opening for the discharge of the cooling gas.

7 Claims, 3 Drawing Sheets

DEVICE FOR COMMINUTING BULK CHARGE STOCK

This nonprovisional application claims priority under 35 U.S.C. §119(a) to German Patent Application No. DE 10 2010 049 485.2, which was filed in Germany on Oct. 27, 2010, and which is herein incorporated by reference.

BACKGROUND OF THE INVENTION

1. Field of the Invention

The invention relates to a device for comminuting bulk charge.

2. Description of the Background Art

When charge stock is comminuted in generic devices, a considerable part of the energy required for the comminuting is converted into heat. This is caused by friction and impact forces to which the charge stock is subjected during comminuting and which primarily act on the comminuting tools.

Known devices are characterized during operation by an air flow, which together with the centrifugal force is the cause of the transport of the charge stock inside the device. This so-called self-ventilation can be generated by the device itself and can optionally be additionally supported from outside with the aid of a blower. If the charge stock is not heat-sensitive, the innate self-generated flow of air in known devices is sufficient in order to cool down the comminuting tools so much that thermal damage to the charge stock is ruled out. Problems regularly occur when heat-sensitive charge stock is to be comminuted. In particular when plastics with a low softening temperature are to be comminuted, the operators of generic devices are faced with a difficult task. On the one hand, a milling of the charge stock is to take place just below the softening temperature in order to achieve the highest possible machine output. If the material-dependent limit temperature is thereby exceeded, the charge stock softens and begins to melt, with the result that individual particles agglomerate such that the size of the particles and the particle distribution of the comminuted material are no longer within the desired range. On the other hand, particles heated above the limit temperature are baked onto the machine parts and in particular the comminuting tools, so that the machine efficiency as well as the quality of the end product suffer as a result.

Foodstuffs and pharmaceuticals are cited as a further example of heat-sensitive charge stock, the chemical composition and effect of which are changed by an excessive heat generation, and losses in quality or even the uselessness thereof must thereby be accepted.

This problem is more marked in the case of fine milling, since it has been shown that the finer the end product to be produced, the more comminuting work has to be done, and the greater the heat generation in the region of the comminuting tools will be.

To avoid a thermal overloading of the charge stock during the comminuting thereof, it is known to lower the machine output of comminuting devices. In this way, less comminuting work is performed per unit of time, thus generating less excess heat. However, as a consequence, it must be accepted that the comminuting apparatus does not operate at full capacity, which goes against the fundamental requirement for an economical operation of such devices. There has therefore already been a change to increasing the quantity of cool air by means of additional blowers beyond the self-ventilation portion of a generic comminuting device, in order thus to be able to dissipate additional heat.

In connection with disk mills it is known to introduce additional cool air directly into the comminuting chamber to cool the milling tools. This takes place through openings in the housing front wall and/or housing rear wall, which are arranged around the rotational axis as close to the axis as possible. After its axial entry into the comminuting chamber through these openings, the cool air flows radially along the rear side of the rotor disk to cool the comminuting tools. A device of this type is disclosed, for example, in DE 10 2004 050 002 A1, which corresponds to U.S. Pat. No. 7,364,100, and which is incorporated herein by reference.

In U.S. Pat. No. 2,959,362 a cutting mill for producing plastic granules is described, which has a rotor equipped with blades over its circumference. The rotor is surrounded by a stator, in which the counter blades interacting with the rotor blades are arranged. A housing surrounds the stator at a clear distance, wherein cool air is blown into the space between the stator and the housing. After the absorption of thermal energy, the cool air is guided out of the housing via an outlet, in order to conduct the thermal energy produced during the cutting work out of the device.

SUMMARY OF THE INVENTION

It is therefore an object of the invention to cool the comminuting region of generic devices as economically and effectively as possible.

The invention is based on the realization that the maximum heat generation inside the comminuting region takes place where the comminuting energy is introduced directly into the charge stock, namely in the region of the comminuting tools. Since the maximum permissible temperature depending on the charge stock is the determining factor for many further operating parameters of the generic device, the basic concept of the invention is to guide a cooling gas stream through a comminuting device such that the cooling effect thereof starts first in the region of the zone with maximum temperature and thus the greatest usefulness is obtained. This is achieved according to the invention in that the cooling gas stream is guided inside a cooling channel around the comminuting zone.

The cooling effect is increased in a manner according to the invention in that in addition a cooling gas partial stream is guided via one or more shell wall openings directly into the circumferential region of the comminuting tools. There the cooling gas is directly loaded with thermal energy and together with the comminuted charge stock is drawn out of the device via the material discharge.

In this manner a cooling gas stream flows along the inner circumference as well as along the outer circumference of the shell wall, with the result that a high temperature gradient is produced from the temperature-affected comminuting zone to the cooled shell wall, which represents the inner drive for an effective heat dissipation.

This type of cooling is particularly effective when the shell wall directly delimits on the one side the comminuting chamber impinged with high temperature and on the other side the cooling channel impinged with cooling gas. Due to the regions separated only by the shell wall, which are characterized by their high temperature gradient, an extremely short and low-resistance heat flow path is produced, which promotes a dense heat flow with large heat quantities in the direction of the cooling channel.

In order to prevent comminuted charge stock after exiting from the comminuting zone and accelerated by the rotor tools from reaching the cooling channel through the shell wall openings, in a further development of this embodiment a housing is provided, which covers the shell wall openings and otherwise extends into the cooling channel. The housing has an opening offset with respect to the shell wall opening, through which the partial cooling gas flow first flows into the housing and then into the comminuting zone via the shell wall openings. Comminuted stock in this manner can collect only in the housing, but not in the cooling channel. It is thereby preferred that the base of the housing adjoins the shell wall openings with an incline so that charge stock located in the housing slides back into the comminuting chamber through the action of gravitational force.

The cooling effect of the cooling gas can in addition be improved in that the cooling channel has an exit opening for the cooling gas stream, which opens into the material inlet. The cooling gas leaving the cooling channel thus together with the charge stock flows through the comminuting zone, where it again absorbs thermal energy, which it then transports out of the device via the material discharge. The cooling potential innate to the cooling gas stream is optimally used in this manner.

Furthermore, a spiral-shaped embodiment of the shell wall is advantageous, so that the ring channel between the shell wall and the outer circumference of the rotor is widened in the rotational direction. As a result of the flow cross section constantly increasing thereby, a disturbance-free material flow through the device is promoted and thus a continuous heat transfer. A comparable effect results with a shell wall running in a circular manner, wherein the rotational axis of the rotor is arranged eccentrically to the center point of the shell wall.

The invention is explained in more detail below based on an exemplary embodiment shown in the drawing, wherein additional features and advantages of the invention are shown. The exemplary embodiment presented below relates to the implementation of the invention in a disk mill, but without being limited to disk mills. Instead, the invention quite generally covers comminuting devices with a circular or cylindrical comminuting zone, which is surrounded by a housing such as, for example, in the case of pin mills, impact mills, hammer mills and the like.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
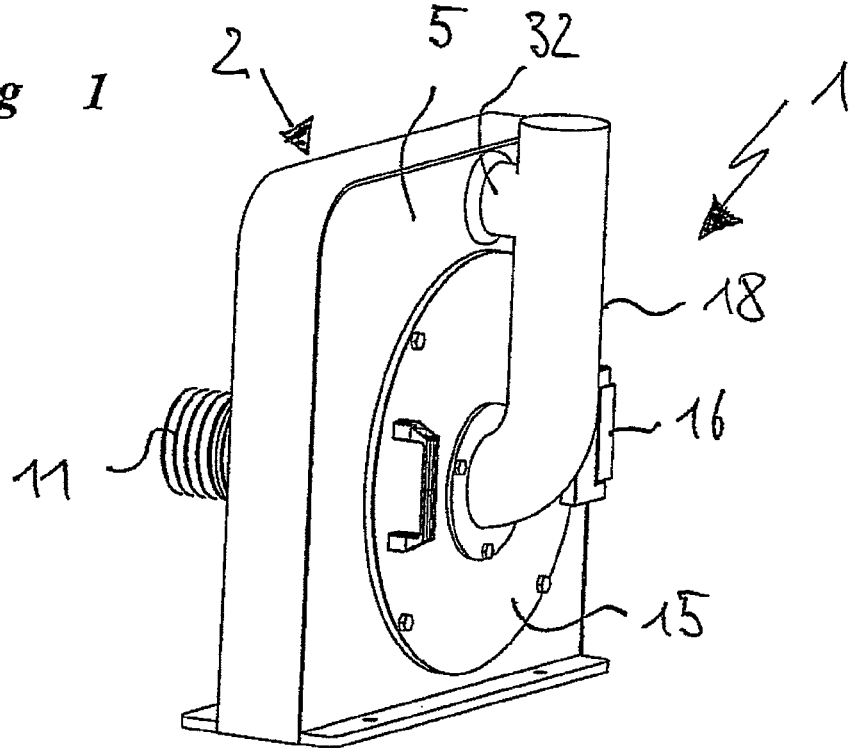
FIGS. 1 and 2 respectively illustrate an oblique view of a device according to an embodiment of the invention.
Figure 2:
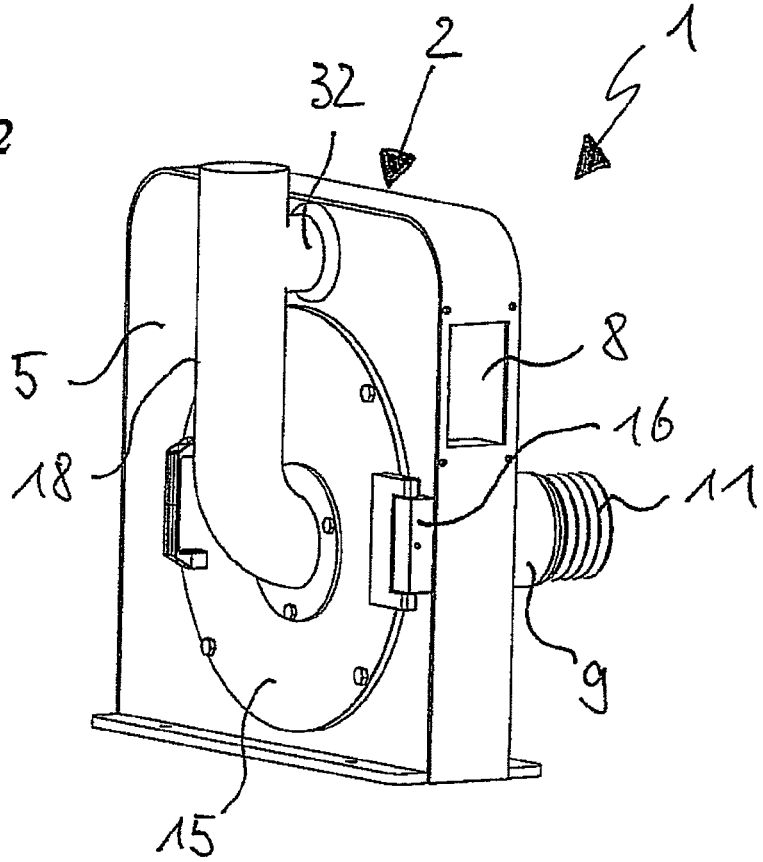
Figure 3:
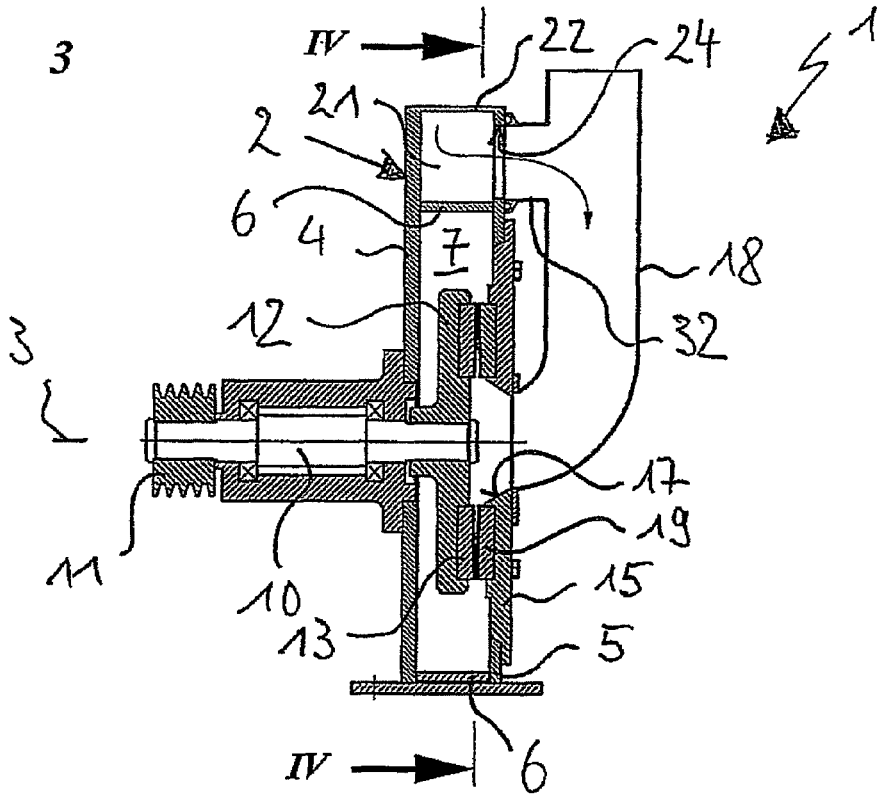
FIG. 3 shows a vertical section through the device shown in FIGS. 1 and 2 along the line III-III shown in FIG. 4.

FIGS. 1 through 4 show a first embodiment of the invention in the form of a disk mill 1. The disk mill 1 has a cylindrical housing 2, which is arranged around a rotational axis 3. The housing 3 is essentially formed by a first front wall 4 and a second front wall 5, both of which run perpendicular to the axis 3 and are arranged at an axial distance from one another. The first front wall 4 and second front wall 5 have an essentially rectangular outline with upper edges rounded. As can be seen above all from FIGS. 3 and 4, the first front wall 4 and the second front wall 5 are connected by a cylindrical shell wall 6, which runs around the axis 3 in a spiral-shaped manner and in this way surrounds a comminuting chamber 7 with the front walls 4 and 5. To form a material discharge 8 opening from the comminuting chamber 7, the first end of the shell wall 6 runs from the upper apex tangentially to the lateral edges of the front walls 4 and 5. Due to a bend, the second end of the shell wall 6 runs parallel and at a distance from the first end, whereby the material discharge 8 is given its channel-shaped form.

The first front wall 4 has an opening concentric to the axis 3, into which opening a hollow cylindrical shaft bearing 9 is coaxially inserted. This serves to accommodate a drive shaft 10, the end of which lying outside the housing 2 bears a multi-groove disk 11, which is coupled with a rotary actuator not shown in further detail. On the end of the drive shaft 10 lying inside the comminuting chamber 7 a support disk 12 is located to accommodate first comminuting tools 13, which are attached to the support disk 12 in the shape of a tool ring or a plurality of individual segments concentrically around the rotational axis 3. A ring channel is thus produced between the comminuting tools 13 and 19 and the shell wall 6, in which ring channel the comminuted charge stock is guided to the material discharge 8.

The second front wall 5 lying opposite likewise has a central housing opening 14 of larger diameter, which lies axially opposite the support disk 12 and which can be closed by a housing door 15 that is pivoted about a hinge 16. A charge opening 17 is arranged concentrically to the axis 3 in the housing door 15, to which charge opening a duct-shaped material inlet 18 adjoins from outside. The inside of the housing door 15 is used to attach second comminuting tools 19, which lie coaxially opposite the first comminuting tools 13 forming a radial milling gap and in this manner form a slit-shaped comminuting zone.

The charge stock, which reaches the central region of the comminuting chamber 7 axially via the material inlet 18, first meets the rotating support disk 12, at which it is deflected and accelerated in the radial direction. The comminuting as intended takes place between the first comminuting tools 13 and second comminuting tools 19 during the passage through the milling gap. The energy input associated therewith causes a temperature increase in the region of the comminuting zone. After exiting from the milling gap, the comminuted stock is colleted in the ring channel and is fed therein to the material discharge 8 and drawn out of the disk mill 1.

In order to dissipate the thermal energy produced during the comminuting work, the disk mill 1 according to the invention is equipped with a cooling channel 21, which is impinged with a cooling gas K of low temperature, for example, with air or an inert gas, such as nitrogen, for example. According to the invention, the cooling channel 21 extends at least over a circumferential section of the shell wall 6.

To form the cooling channel 21, the first front wall 4 and the second front wall 5 are guided radially beyond the shell wall 6, namely by an amount that corresponds to the desired height of the cooling channel 21. The edges of the first front wall 4 and the second front wall 5 are connected by means of a perimeter outer housing wall 22, the base part of which is widened to form a machine base. The cooling channel 21 is thus delimited in the axial direction by the overhangs of the first front wall 4 and the second front wall 5 and in the radial direction by the shell wall 6 and outer housing wall 22. The cooling channel 21 thus has an axial width that corresponds to the distance of the first front wall 4 from the second front wall 5 and a radial height corresponding to the distance of the shell wall 6 from the outer housing wall 22.

An access opening 23 in the housing wall 22 makes it possible to supply the cooling gas K into the cooling channel 21. The exit out of the cooling channel 21 is carried out via an exit opening 24 in the second front wall 5 above the apex of the shell wall 6. The exit opening 24 is connected to the material inlet 8 via a connecting pipe 32. It can be established by a corresponding arrangement of the access opening 23 and exit opening 24 relative to the shell wall 6 over which circumferential section the cooling channel 21 extends and thus where the shell wall 6 is to be impinged with cooling gas K.

In order to avoid dead zones in the cooling channel 21 that are not flowed through or flowed through only slightly, a first flow wall 25 is provided, which extends parallel to the outer housing wall 22 from the access opening 23 to the shell wall 6. A second flow wall 26 connects directly at the side of the exit opening 24 the outer housing wall 22 to the shell wall 6 and ensures a forced diversion of the cooling gas stream K in the direction of the exit opening 24.

Figure 4:
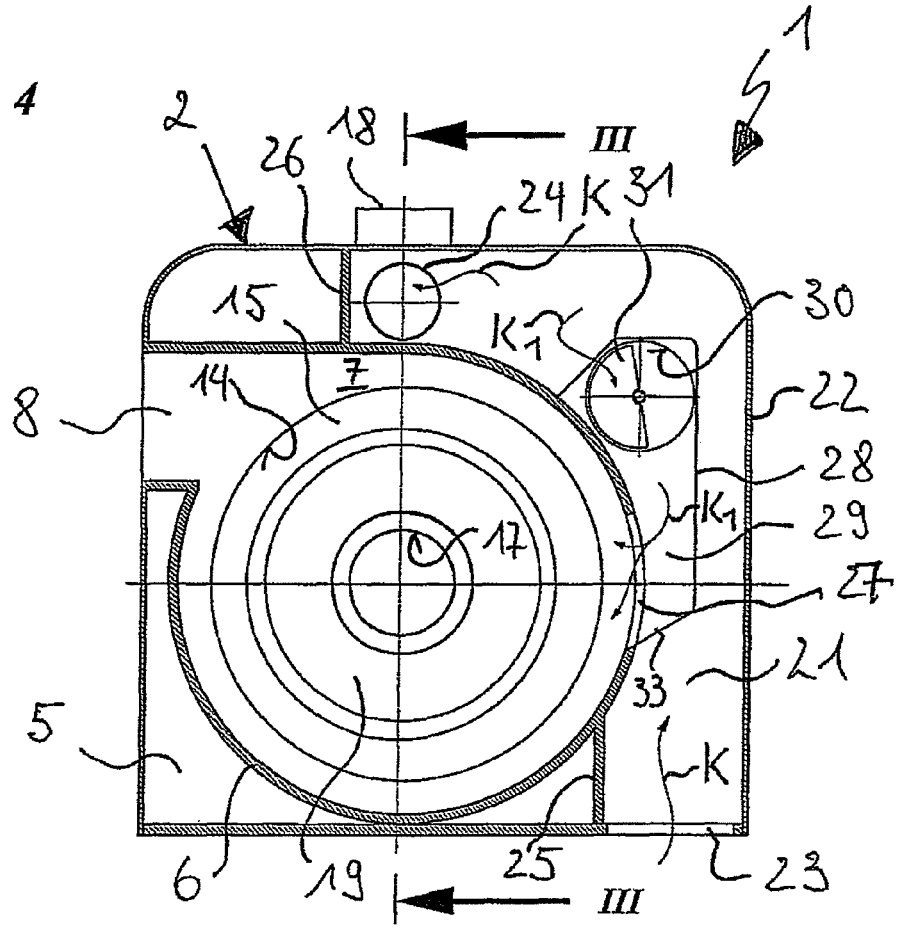
FIG. 4 shows a section through the device shown in FIG. 3 along the line IV-IV there and FIG. 5 shows a section according to FIG. 4 through an alternative embodiment of a device according to the invention.

FIG. 4 shows that the shell wall 6 has a rectangular shell wall opening 27 at the level of the rotational axis 3, which shell wall opening extends in the axial direction from the second front wall 5 up to approximately over half of the width of the shell wall 6. The shell wall opening 27 is surrounded by a box-shaped housing 28, the base 33 of which adjoins the shell wall opening 27 with an incline to form a slide. In the axial direction the housing 28 as well as the shell wall opening 27 ends at approximately half the width of the cooling channel 21 and is closed there via a side wall 29 running plane parallel to the front walls 4 and 5. The housing 28 extends upwards beyond the shell wall opening 27 and has a circular opening 30 there in the side wall 29, the free cross sectional opening of which circular opening is adjustable by means of a control element 31.

During the operation of the cutting mill 1 a partial cooling gas flow $K_1$ is branched off from the cooling gas flow K flowing through the cooling channel 21, and guided via the opening 30 and the shell wall opening 27 directly into the circumferential region of the first comminuting tools 13 and second comminuting tools 19, and there loaded with thermal energy. The remaining cooling gas stream K reaches the material inlet 18 via the exit opening 24 and the connecting pipe 32 and together with the charge stock flows through the comminuting zone in the radial direction. The cooling gas thereby absorbs thermal energy and guides it away with the exit from the cutting mill 1 via the material discharge 8.

A further cooling of the disk mill 1 takes place via the shell wall 6, first front wall 4 and second front wall 5 cooled by the cooling gas stream K, which surround the comminuting chamber 7 in a quasi U-shaped manner and absorb and dissipate the thermal energy emitted by the comminuting tools 13 and 19.

The control of the cooling capacity is carried out via the temperature and flow rate of the cooling gas stream K as well as the division thereof into a partial cooling gas stream $K_1$ and remaining cooling gas stream K1, which takes place with the aid of control elements 31 at the opening 30 and/or exit opening 24.

Figure 5:
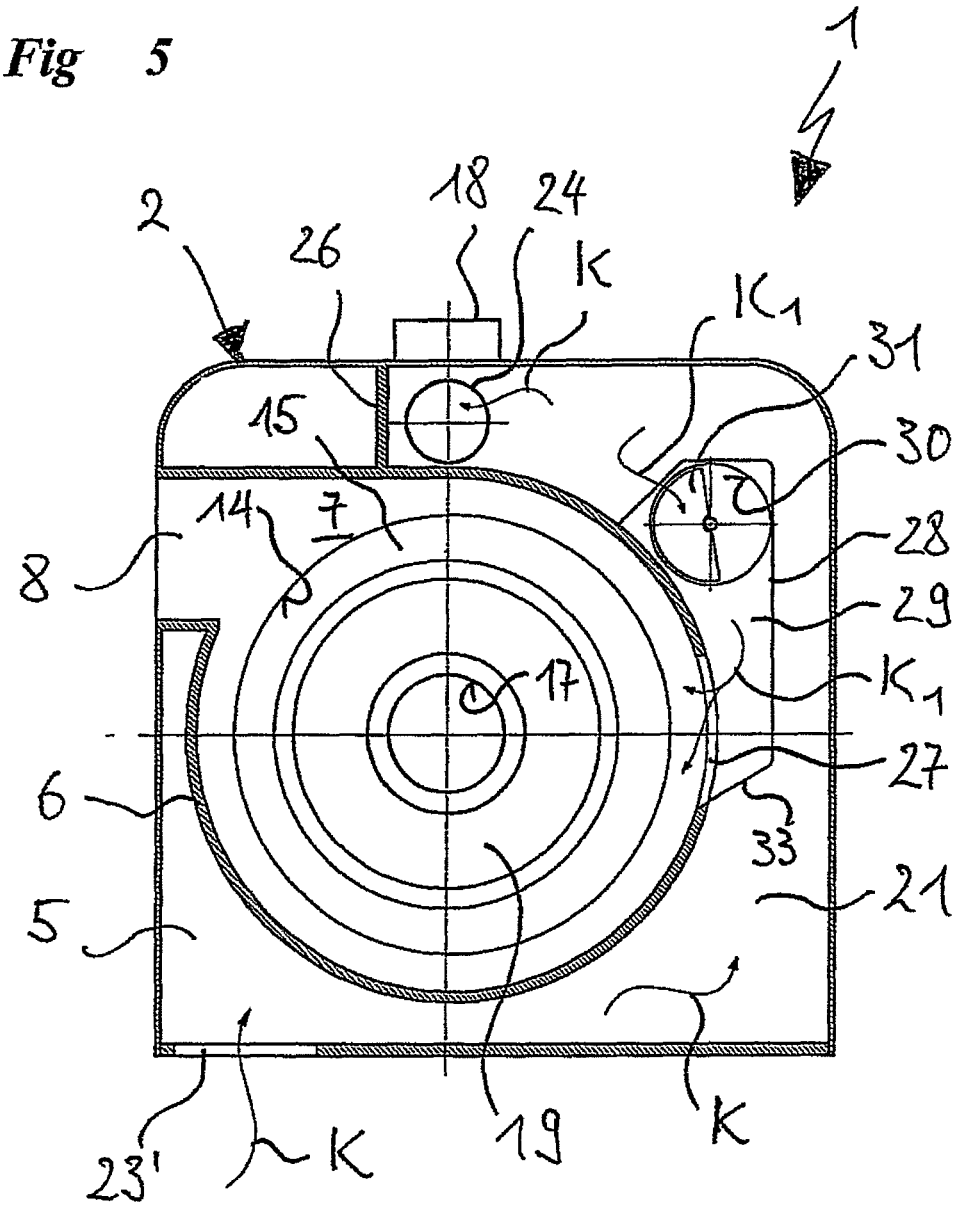

FIG. 5 shows a section through a second embodiment of the invention, wherein the section line corresponds to that of FIG. 4. The second embodiment of the invention differs from that described in FIGS. 1 through 4 only in that the access opening 23' is arranged at a different location inside the housing 2. Through an offset of the access opening 23' counter to the rotational direction of the support disk 12 and an enlargement of the radial distance between the base of the outer housing wall 22 and the shell wall 6, the cooling channel 21 is extended and thus the cooling effect exerted thereby is increased.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for comminuting bulk charge stock, the device comprising:
   - a housing surrounding a rotational axis with a first front wall, a second front wall plane parallel at an axial distance, and a shell wall connecting the first front wall and second front wall on a circumferential side, which together form a comminuting chamber;
   - a material inlet to which the charge stock is fed;
   - a material discharge via which the charge stock removed; and
   - a comminuting system rotating about the rotational axis arranged in the comminuting chamber, the comminuting system comprising:
     - first comminuting tools;
     - second comminuting tools interacting with the first comminuting tools, and which form a concentric comminuting zone in which the charge stock is comminuted; and
     - a cooling channel that is configured to be acted on with a cooling gas stream via an entry opening that surrounds the shell wall in a plane of the comminuting chamber and radially outside thereof at least in part,
     - wherein the shell wall has at least one shell wall opening via which a partial cooling gas stream branched off from the cooling gas stream is configured to be fed from the cooling channel into the comminuting chamber.

2. The device according to claim 1, wherein the shell wall is part of the comminuting chamber as well as part of the cooling channel.

3. The device according to claim 1, wherein the at least one shell wall opening is surrounded by a housing, which extends into the cooling channel and which is connectable to the cooling channel via an opening.

4. The device according to claim 1, wherein the cooling channel has an exit opening for the cooling gas stream, which opens into the material inlet.

5. The device according to claim 1, wherein the entry opening and/or the exit opening and/or the shell wall opening and/or the opening in the housing have a control element that is configured to adjusting the cooling gas flow rate.

6. The device according to claim 1, wherein the cooling channel extends over an arc length of at least 120° or at least 180°.

7. The device according to claim 1, wherein the shell wall is embodied in a circular or spiral-shaped manner.

* * * * *